US005481273A

United States Patent [19]

Shigeta et al.

[11] Patent Number: 5,481,273

[45] Date of Patent: Jan. 2, 1996

[54] TRANSMISSION CIRCUIT OF DISPLAY SIGNAL FOR LIQUID CRYSTAL DISPLAY AND TRANSMISSION METHOD THEREOF

[75] Inventors: Mitsuhiro Shigeta, Kyoto; Keisaku Nonomura, Nara; Kazuyuki Kishimoto, Ikoma, all of Japan

[73] Assignee: Sharp Kabushiki Kaisha, Osaka, Japan

[21] Appl. No.: 273,932

[22] Filed: Jul. 12, 1994

[30] Foreign Application Priority Data

Jul. 13, 1993 [JP] Japan ..... 5-173162

[51] Int. Cl.[6] ..... G09G 3/36

[52] U.S. Cl. ..... 345/94; 345/87; 345/90

[58] Field of Search ..... 345/90, 91, 92, 345/93, 94, 97, 95, 96, 87, 205, 206; 364/221

[56] References Cited

U.S. PATENT DOCUMENTS 4,328,493 5/1982 Shanks ..... 345/94
4,896,053 1/1990 Kesselring ..... 364/221
5,302,966 4/1994 Stewart ..... 345/76

FOREIGN PATENT DOCUMENTS 56-29224 7/1981 Japan .

OTHER PUBLICATIONS

Japanese patent publication 56–2922x, 1981.
Maltese, Paolo, "Cross–modulation and disuniformity reduction in the addressing of passive matrix displays", 1984.

*Primary Examiner*—Richard Hjerpe
*Assistant Examiner*—Kent Chang
*Attorney, Agent, or Firm*—David G. Conlin; Milton Oliver

[57] ABSTRACT

A large-scale liquid crystal display comprises a signal transmission channel which includes an inductance in the line direction and in the column direction for transmitting a display signal of the large-scale display to a pixel without delay. The signal transmission channel is arranged so that the display signal is propagated in the form of solitary waves or solitons whereby an LCD can be driven with a uniform display and a high contrast.

12 Claims, 5 Drawing Sheets

TRANSMISSION CIRCUIT OF DISPLAY SIGNAL FOR LIQUID CRYSTAL DISPLAY AND TRANSMISSION METHOD THEREOF

BACKGROUND OF THE INVENTION

1. Field of the Invention

The present invention relates to a display device for use in AV (audio-visual) apparatus, OA (office automation) apparatus, computers or the like, more particularly to its transmission circuit and its transmission method.

2. Description of the Related Art

Flat displays which display images on a principle different from the counterpart of CRT displays are widely applied on the market of word processors and personal computers. Development is under way to apply such flat displays to high-quality television sets and high performance EWS (engineering work stations).

Examples of typical flat displays include ELP's (electroluminescence panels), PDP's (plasma display panels) and LCD's (liquid crystal displays). Out of such displays, LCD's are regarded as the most promising because LCD's can be easily formed into a full-fledged color display and LCD's can well match LSI (large scale integrated) circuits as compared with displays of other kinds.

LCD's are roughly available in two types, a simple matrix driving LCD and an active matrix driving LCD, depending on the driving method.

Simple matrix driving LCD's comprise a pair of glass plates, stripe-like electrodes formed on the pair of glass substrates and a liquid crystal being disposed therebetween, the pair of glass plates being located opposite to each other so that the stripe-like electrodes formed on glass plates run at right angle to each other, whereby the LCD displays images with an sensitive display properties inherent in liquid crystals.

On the other hand, active matrix driving LCD's are constituted so that non-linear elements are added to pixels and images are displayed with switching properties inherent in each of the elements. Consequently, the active matrix type LCD's less depend on the sensitive display properties of the liquid crystals than the simple matrix driving type LCD's thereby realizing a display having a high contrast and being capable of quick response.

The non-linear elements are available in two types; two terminal elements and three terminal elements. Examples of two terminal non-linear elements include MIM's (metal-insulator-metal) and diodes. On the other hand, three terminal non-linear elements include a-SiTFT's (amorphous silicon thin film transistors) and p-SiTFT's (polysilicon thin film transistors).

However, large scale liquid crystal displays provide long wirings so that a wiring resistance R rises, a signal delay generated by the connection of the wiring resistance R and a parasitic capacitance (floating capacitance) C becomes larger which aggravates the uniformity of the display and a high contrast thereof. To avoid such drawback, an attempt has been made to analyze configurations of display pulses in each pixel. However, the non-linear properties of elements cause much difficulty to the theoretical analysis of the configuration, so computers are used for simulating the configuration of the display pulses.

In this manner, active matrix driving LCD's have drawbacks such as a contrast deterioration, residual images and a shortened panel life because of the presence of the parasitic capacitance between the non-linear element and the scanning line. Consequently, longer wiring length resulting from an increase in the size of displays further raises the wiring resistance R thereby providing further prolonged signal delay generated by the connection of the wiring resistance R and the parasitic capacitance C which is likely to further aggravate the uniformity in display and to impede the improvement in the display contrast.

Such phenomenon can be detailed with respect to an RC ladder-type circuit shown in FIG.7. In simple matrix driving displays and active matrix driving displays, there exists a resistance R held by a signal line and a capacitance C generated either between signal lines or between the non-linear element and a common electrode. In such case, a circuit equation relative to a current In flowing through an nth node 3 shown in FIG. 7 is represented as follows.

$$RIn=Vn-Vn+1$$

$$dQn/dt=In-1-In$$

Here, Symbol Vn designates a voltage at the nth node, Q an amount of electric load accumulated in the nth capacitance C.

Hence, when the current is reduced, the following equation is given.

$$RdQn/dt=Vn-1-2Vn+Vn+1$$

When the left side of the above equation is approximated to a linear form (Q=CV) and the right side is converted into a differential form, the following diffusion equation is given.

$$RC/\Delta^2\partial V/\partial t=\partial^2 V/\partial X^2$$

where symbol Δ designates a distance between two nodes of the network.

This shows that the square-shaped waveform of the voltage applied to this circuit is deformed into a configuration broading toward the bottom thereof while diffusing on a signal line. The non-linear properties of the element cause difficulties to the analysis of the configuration of the display pulses in each pixel. Computer simulation, thus, has been used. Consequently, it has been desired that an epoch-making new technology appear that can realize a uniform and a large-size and large-capacity display by overcoming the above difficulties.

To overcome such problem, a display signal of solitons may possibly be used as means of communicating image display signals to pixels. Solitons change a mode of propagating display signals from a propagation through diffusion to a propagation through wave motion with minimum signal delay and deformation of waveforms of the display signals in the transmission channel.

Solitons were found in 1965 as a wave that can be described in K-dV (Korteweg-de Vries) equation. The equation includes both non-linear items and diffused items. Solitons can be formed by a balance between a projection of waves caused by non-linear items and an expansion of waves caused by diffused items. Solitons are characterized by the fact that they never collapse even after mutual overtaking and mutual collision. The name "soliton" comes from the very fact that it behaves like a particle while maintaining its size before and after mutual collision.

The transmission circuit of solitons comprises a nonlinear LC ladder-type circuit network. The capacitance of the circuit network is generated by the junction of diodes or FET's (Field Effect Transistors) used in the switching of pixels or between the transmission channel and ground electrode. Inductors can be composed of coils, but using such inductors enlarges the whole circuit.

In addition, the relation between the pulse height and pulse width in solitons is set to a definite value. Propagating a signal having a wide pulse width requires heightening the pulse height. Consequently, driving the display at a low voltage requires using a multi-solitons solution, but the multi-solitons solution similar in the form of square-shaped pulses generates a superfluous vibrations which are not appropriate to be used as a display signal.

Incidentally, as a known device using an LC ladder-type circuit, Japanese Published Patent No. SHO 56-29224 describes a frequency selection and display apparatus comprising tuners having different tuning frequencies, the tuners being constituted so that an inductance and capacitance of tuners prevent the attenuation of information and the deterioration thereof in the direction of propagation, and the response scope of frequencies is extremely widened, the tuners selectively generating either electric and mechanical vibrations so that the display device connected to the outside converts frequencies included in information into a visible form with a liquid crystal.

SUMMARY OF THE INVENTION

The present invention has been made under such circumstances, and an object of the invention is to provide a transmission circuit of a display signal for an LCD and a transmission method thereof, both the circuit and the method being preferably used in a high quality, large-scale display and a flat LCD.

The present invention provides the following means to solve the problems.

Therefore, the present invention provides a transmission circuit of a display signal for a liquid crystal display, which comprises a transmission channel including a scanning line and data signal line arranged so as to constitute a pixel, and having a capacitance and an inductance, said transmission circuit providing an inductor having a predetermined inductance value and being arranged in the transmission channel.

Furthermore, the present invention provides a transmission method of the transmission circuit being driven by applying a voltage to the transmission channel and varying at least one of the capacitance and the inductance in a non-linear relation to the applied voltage while propagating the display signal either in the form of solitons or in the form of solitary waves.

Single matrix driving LCD's and active matrix driving LCD's generate a signal delay with the resistance R signal lines have and with a capacitance C signal lines and non-linear elements have. However, as shown in the present invention, application of inductance L to the transmission channel allows the propagation of wave motion, and still the non-linear properties of the capacitance or the inductance L allows the propagation of solitons. This improves the signal delay caused by the RC delay time, thereby providing a uniform display and a high contrast. This will be an epoch-making new technology for large-scale and large capacitance display.

DESCRIPTION OF THE PREFERRED EMBODIMENTS

Figure 1:
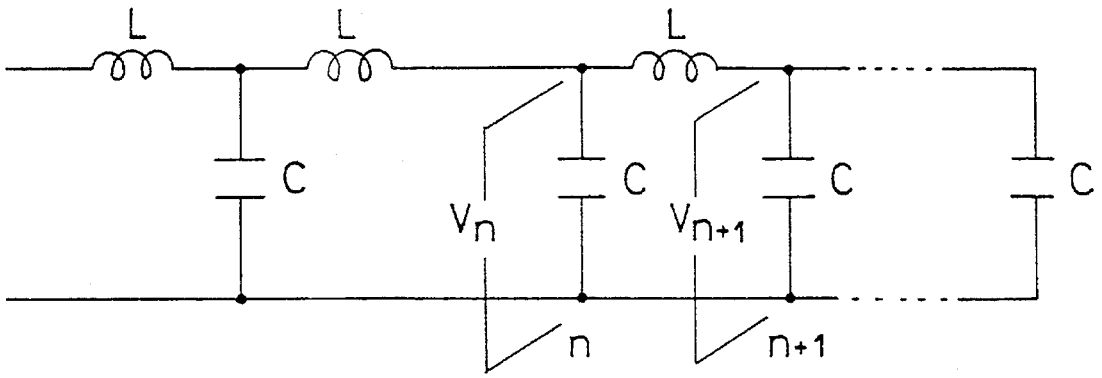
FIG. 1 is a view showing a circuit structure of an LC ladder-type circuit, the view showing a structure in accordance with the present invention.

An inductor for use in a transmission circuit of the present invention may be of any type as long as the inductor has a predetermined inductance value. Each kind of inductor may be used.

The inductance value may be any value, as long as the value allows propagating a display signal in the form of solitons or in the form of solitary waves into the transmission channel for transmitting a display signal of an LCD. The value can be any as long as it satisfies the following condition;

$$L>10^{-20}/C$$

where L represents an inductance value (unit: H, henry) which the inductor has, and C represents a parasitic capacitance value (unit: F, farad) which the transmission circuit of a display signal for the LCD has.

"Solitary waves" here mean a pulse-like wave which is represented either in the form of a linear or non-linear wave motion equation whereas "solitons" mean a kind of solitary waves which do not change their configuration, even when they collide with each other, and solitons are represented in a non-linear wave motion equation.

As such inductor, an inductor can be applied in which, for example, a predermined inductance value is obtained with an inductance generated between a transmission channel of a scanning line and data signal line for transmitting a display signal for an LCD and another transmission channel provided adjacent to the former transmission channel.

As such transmission channel of the scanning line and the data signal line for transmitting the display signal of the LCD and another transmission channel provided adjacent to the former channel, a transmission channel can be used which assumes either of the following structures; a structure similar to a coaxial cable, a structure similar to a configuration having a dome-like cross section which is similar to a half-cut coaxial cable, or a structure similar to a two-line feeder.

Additionally, any known active inductor can be used as the above inductor. Examples of such known active inductors include an active inductor comprising a FET for cascade connection and a resistance for feedback and an active inductor comprising a FET for cascade connection and a FET for feedback.

For the propagation of the display signal through the transmission channel of the LCD in the form of solitons or in the form of solitary waves in the transmission circuit in accordance with the present invention, most preferably the inductor is arranged in the transmission channel of the liquid crystal display spaced apart by one pixel with respect to the adjacent inductor. However, when a sufficient space for the arrangement of inductors cannot be available, the inductor can be arranged therein spaced apart by a plurality of (an integer number) pixels with respect to the adjacent inductor. In the latter case, the arrangement of inductors can provide an advantage corresponding to the number of inductors.

Preferably, the transmission method of the present invention propagates into the transmission channel of the present invention a display signal either in the form of solitons or in the form of solitary waves by varying either or both of a capacitance and an inductance into a non-linear configuration with respect to the applied voltage.

The fact that the capacitance varies in the non-linear relation to the applied voltage can be represented in the following mathematical expression:

$$C \propto \sqrt{V} \text{ or } C \propto 1/\sqrt{V}$$

(C: capacitance, V: applied voltage)

The above fact simply means that the inductance L varies with the applied voltage. In addition, the fact that the inductance varies in the non-linear relation with the applied voltage is represented in the following mathematical expression:

$$L \propto \sqrt{V} \text{ or } L \propto 1/\sqrt{V}$$

(L: inductance, V: applied voltage)

Furthermore, in the transmission method of the present invention, a pulse width of one-soliton solution in the transmission channel constitutes a basic pulse width. Using a multi-solitons solution provides a display signal having a pulse width longer than the basic pulse width with the result that the display signal can be propagated through the above transmission channel of the present invention.

In such case, preferably a display signal comprising either solitons or solitary waves is propagated in the transmission channel of the present invention with a signal generation circuit comprising an LC circuit network including an inductor. As such inductors included in the LC circuit network, the above known active inductors can be used.

What should be noted in the present invention at first is a finding that an image display and long-distance communication have some similarities with each other when display pixels are regarded as nodes and the transmission channel as a communication cable. This means that using transmission channels and transmission methods for use in the long-distance communication in the propagation of an image display signal in a large-scale LCD allows the realization of a large-scale LCD with a little signal delay and small deformation of waveforms.

Coaxial cables and optical fibers used in the long-distance communication allow a long-distance propagation of signals by radiation of electric waves and light through the transmission channel. A typical LAN (local area network) comprising coaxial cables has the ability to communicate to a terminal having 1000 nodes or more at a rate of 10 Mbps or more.

An equivalent circuit of the coaxial cable will be detailed hereinbelow. The coaxial cable provides an inductance L and a capacitance C as shown in FIG. 1. The equivalent circuit is given as an LC ladder-type circuit. Consequently, the circuit equation is represented as follows with respect to the coaxial cable:

$$Ld^2Qn/dt^{2+}\ RdQn/dt=Vn-1-2VN+Vn+1$$

The above equation can be converted into a wave motion equation when the right side mathematical expression is converted into a differential form and Symbol Q is approximated by a linear form.

Consequently, when the inductance L is included in the transmission channel, the signal is propagated in accordance with the wave motion equation. Signals can be propagated at a rate much faster than a case in which signals are propagated by diffusion as can be seen in the RC ladder-type circuit. Furthermore, when either the capacitance C or the inductance L has a configuration non-linear to an applied voltage, it has been verified that the phenomenon thus generated can be represented by the K-dV equation including scattering. From a solution of the equation, the soliton rate V can be represented by the following formula;

$$V=(1/\sqrt{(LC)})+F(A)$$

where C represents a differential capacitance when the capacitance stands in inverse proportion to the voltage and F (A) represents an item proportional to the frequency width A of solitons.

These mathematical expressions show that application of the inductance L to the transmission channel converts a mode of transmitting a signal from propagation through diffusion to propagation through wave motion whereby a deformation delay ceases to be generated in the image display signal. In such case, the non-linear properties of the inductance L are not necessarily required because the joining of diodes with FET's (Field Effect Transistors) used in pixel switchings produces non-linear properties of the capacitance.

In addition, active inductors comprising inductive elements constituted of FET's match in the process with an active matrix driving method as a method for driving LCD. Furthermore, solitons are available either in the form of one-soliton solution or in the form of a multi-solitons solution. These solitons have a pulse width based on the pulse width of one-soliton solution with respect to a definite voltage. The pulse width of the display signal can be selected from the multi-solitons solution.

The present invention will be detailed in conjunction with Embodiments 1 through 3 shown in the drawings which are not intended to limit the scope of the present invention.

Embodiment 1

Figure 7:
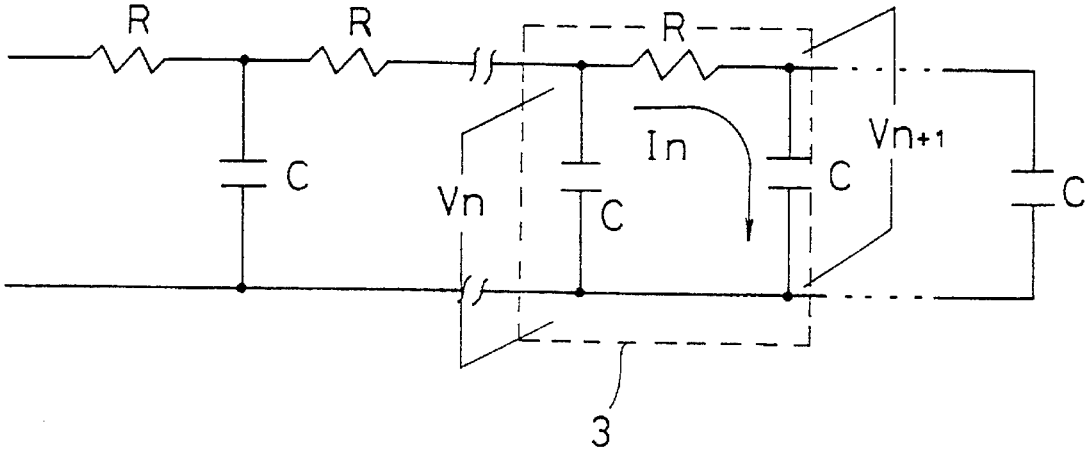
FIG. 7 PRIOR ART
FIG. 7 is a view showing a structure of an RC ladder-type circuit showing a conventional transmission circuit for a display signal for liquid crystal displays.

A transmission circuit of a display signal for an LCD for use in a simple matrix driving LCD and an active matrix driving LCD can be represented by an equivalent circuit having a resistance R present in a signal line and a capacitance C generated by the signal line or a non-linear element as shown in FIG. 7.

However, since such transmission circuit propagates the display signal by diffusion, the circuit has much difficulty in providing a high rate and long-distance transmission of signals. Thus, in such configuration of the transmission circuit, as shown in FIG. 1, an inductance L is applied to the inside of the transmission channel at intervals of one pixel or a plurality of pixels. Then the circuit allows either the capacitance C in the transmission channel or the inductance L or both of them to vary in a non-linear relation with respect to the applied voltage.

In other words, into the transmission channel an inductor of the inductance value is inserted which satisfies the following equation.

$$L>10^{-20}/C$$

where Symbol L represents an inductance value (unit: H, henry) the inductor has, and C represents a parasitic capacitance (unit: F, farad) the transmission circuit of a display signal for an LCD has.

Inductive elements constituting an inductor are preferably arranged spaced apart by one pixel each other. When sufficient space is not available, the inductive elements may be arranged spaced apart by a plurality of pixels with respect to the adjacent inductor. In such case, the same advantage can by yielded by a smaller number of inductors.

For example, the capacitance C varies with the applied voltage V in a relation represented in the following mathematical expression.

$$C \propto \sqrt{V} \text{ or } C \propto 1/\sqrt{V}$$

(C: capacitance, V: applied voltage)

Otherwise, the inductance L varies with the applied voltage in a relation represented in the following mathematical expression.

$$L \propto \sqrt{V} \text{ or } L \propto 1/\sqrt{V}$$

(L: inductance, V: applied voltage)

In the mathematical expression, the inductance L varies with the applied voltage.

In the above circuit, as described above, the display signal can be propagated in the form of solitons or in the form of solitary waves. In actuality, the capacitance C behaves in a non-linear manner with respect to the applied voltage (in inverse proportion to the applied voltage or in inverse proportion to the square of the applied voltage). Thus the inductance L is not required to be specifically formed into a non-linear element.

Here solitary waves mean pulse-like waves which are represented either in a linear or non-linear wave motion equation. Solitons are a kind of solitary waves which do not change their configuration even when they collide each other. Solitons can be represented in a non-linear wave motion equation. To put it differently, solitary waves do not provide a particular solution to the non-linear LC circuit network and do not satisfy the wave motion equation. In other words, solitons provide a specific solution to the non-linear LC circuit network and which satisfy the equation.

Figure 2:
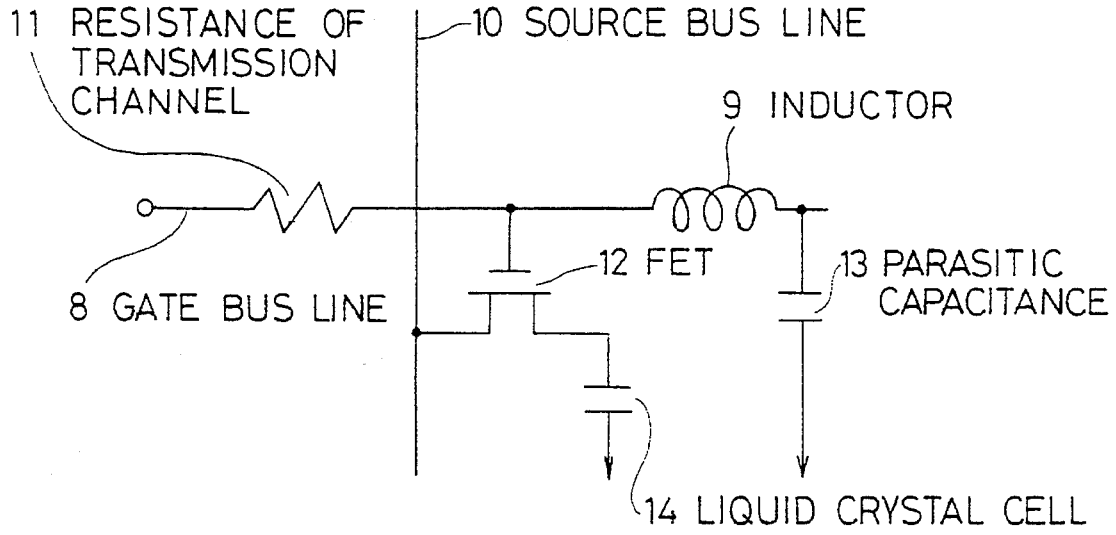
FIG. 2 is a view showing an example of a transmission circuit of a display signal for an LCD in accordance with the present invention.

FIG. 2 is a view illustrating an example of a transmission channel of a display signal for an LCD in accordance with the present invention, the view representing a concept of a liquid crystal driving network. Referring to FIG. 2, Reference Numeral 8 represents a gate bus line (scanning electrode line), 9 an inductor provided on a gate bus line 8, 10 a source bus line (signal electrode line), 11 a resistance of a transmission channel, 12 a FET (field effect transistor), 13 a parasitic capacitance caused by the FET 12 and the transmission channel and 14 a liquid crystal cell. FIG. 2 shows a case in which the inductor 9 is applied to the gate bus line in the midst of the transmission channel. The same advantage can be given when the inductor 9 is applied to the source bus line 10.

As shown in FIG. 2, the equivalent circuit of the transmission channel for driving the liquid crystal cell 14 is represented by the inductor 9, the resistance 11 of the transmission channel, and the parasitic capacitance 13 caused by the FET 12 and the transmission channel. This inductor 9 comprises a known active inductor. The known active inductor which can be used is described in the construction and properties of low loss active inductor carried on pages 1 through 11 of MW89-11 published by IEICE(The Institute of Electronics Information and Communication Engineers).

Figure 3:
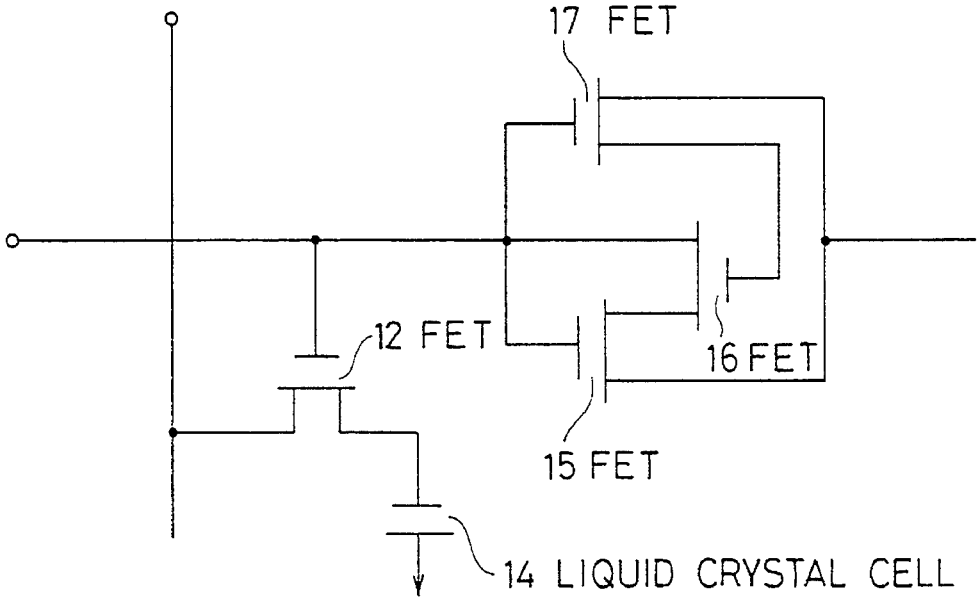
FIG. 3 is a view showing one example of a structure of an active inductor in accordance with the present invention.

FIG. 3 shows an example of a structure of the active inductor. As shown in FIG. 3, the active inductor comprises three FET's, an FET 15, an FET 16 and an FET 17. The FET 15 and the FET 16 are connected to a cascade grounded at the source. To such structure the FET 17 for feedback is provided. The inductance value L of such circuit is represented by an equation of $L=C_{gs}/g_m g_{mf}$ where Symbol $C_{gs}$ represents a capacitance between gate and source of the FET 15 and FET 16, $g_m$ a mutual conductance and $g_{mf}$ a mutual conductance of the FET 17.

When the propagation properties were examined by applying a pulse corresponding to one soliton to the active inductor.active matrix TFT (thin film transistor) driving circuit using a TFT having a gate length of 20 mm, the range of the operation frequency was 5 GHz or less.

Embodiment 2

A transmission method using a transmission circuit of the display signal for an LCD described in Embodiment 1. Embodiment 2 describes in detail a method for applying the display signal to the active matrix inductor-active matrix TFT driving circuit.

Solition solutions are known to be given either as one-soliton solution or as a multi-solitons solution. However, the multi-solitons solution cannot be described as a stack of a plurality of one-soliton solutions. The reason therefor is that the basic equation includes a non-linear item. In the display signal, signals having a long pulse width is required, but a mere stack of the plurality of one-soliton solutions generates a vibration in the waveforms. Avoidance of the generation of such vibration in waveforms requires preparation of the multi-solitons solution depending on the pulse width and application of such multi-solitons solution to the transmission circuit.

Figure 4:
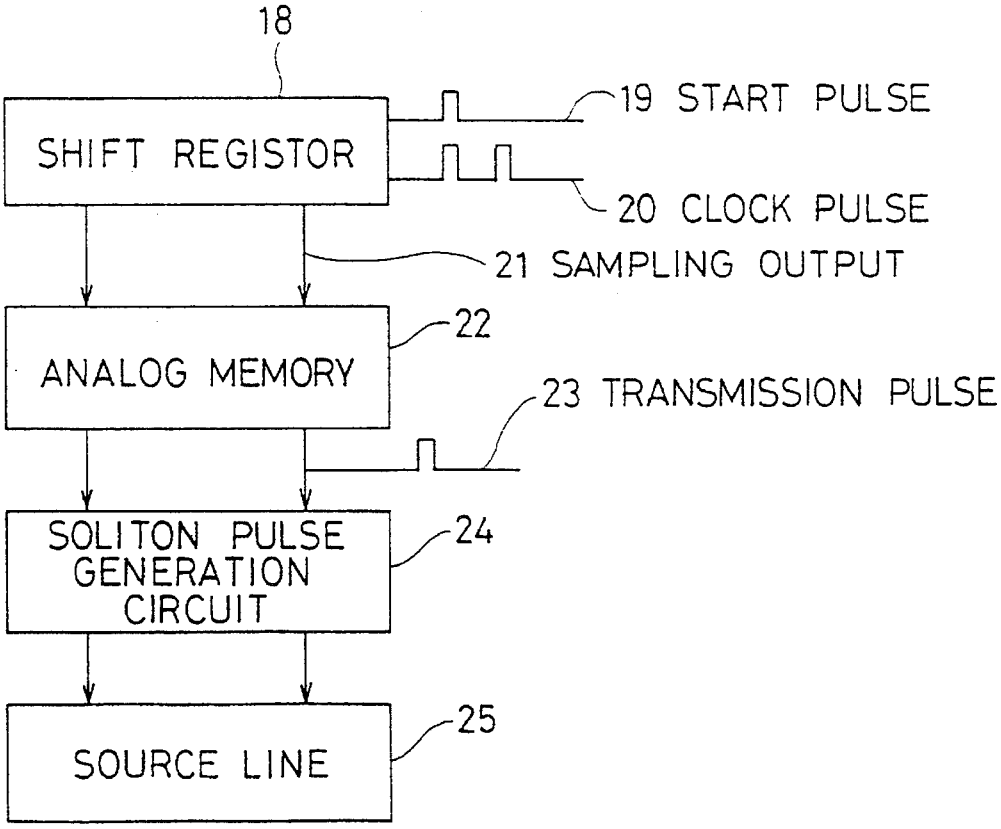
FIG. 4 is a block diagram showing a structure of a source driver circuit for applying a multi-solitons solution of the present invention is applied.

FIG. 4 is a block diagram showing a structure of a source driver circuit for applying a multi-solitons solution. As shown in FIG. 4, in the source driver circuit for applying the multi-solitons solution, a start pulse 19 given to a shift register 18 and a clock pulse 20 functions to temporarily accumulate a sampling output 21 output from the shift register 18 in an analog memory 22. Furthermore, a transmission pulse 23 sends a voltage to a soliton pulse generation circuit comprising an LC non-linear ladder-type circuit to be output to a source line 25. The soliton pulse generation circuit 24 comprises an LC non-linear ladder-type circuit network equivalent to the transmission circuit as shown in FIG. 1 and uses an active inductor as shown in FIG. 3.

In this manner, the soliton pulse generation circuit 24 generates a pulse comprising multi-solitons by varying a voltage value to be entered to the circuit 24 over time to provide a multi-solitons solution. Then the such pulse is propagated to the transmission circuit.

In Embodiment 2, the capacitance C stands by nature in inverse proportion to the voltage. The differential capacitance C is 1 pF(picofarad) whereas the inductance L is 5 nH(nanohenry). The LC non-linear circuit network has 50 steps. One-soliton solution in this circuit has a pulse width of 0.5 nsec (nanosecond) with respect to a peak voltage of 5 V. Producing multi-solitons through the input of a pulse having a pulse width of 6 μsec (microseconds) to this LC non-linear circuit network to be applied to the transmission circuit allows the propagation of the pulse through the transmission circuit without delay.

Embodiment 3

Embodiment 3 describes a method for adding an inductance L to a transmission circuit for a display signal for an LCD by providing a channel different from the transmission circuit for the display signal.

In Embodiment 3, an inductor such as an active inductor is not particularly provided. An inductance value satisfying a mathematical expression of $L>10^{-20}/C$ is obtained by an inductance generated between a transmission channel of a scanning line and/or a data signal line for transmitting a display signal for an LCD and another transmission channel provided adjacent to the former transmission channel.

Figure 5:
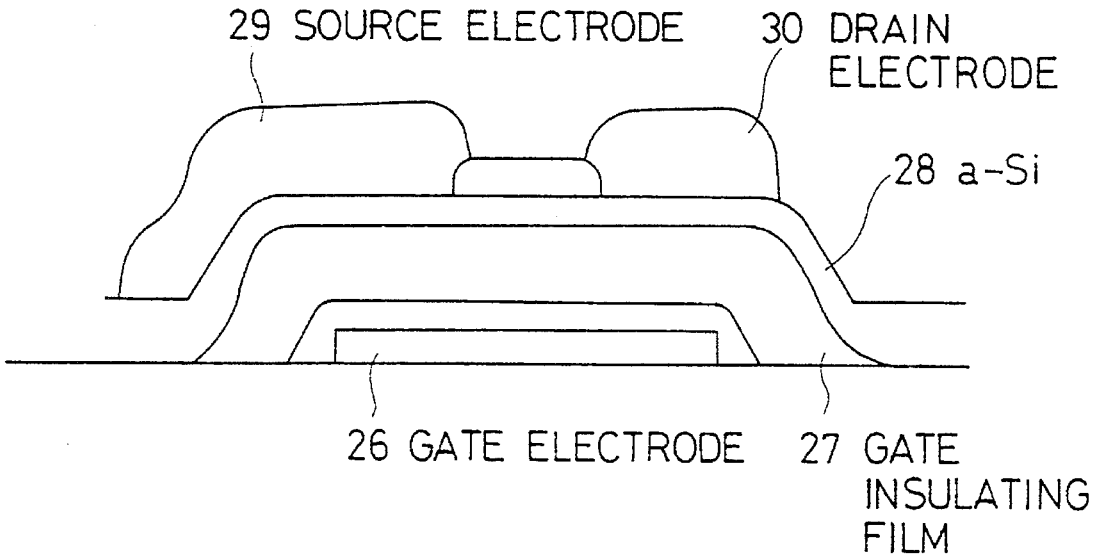
FIG. 5 is a view showing an outline of a cross section structure of a reverse stagger type a-SiTFT in accordance with the present invention.

FIG. 5 shows an outline of a cross section structure of a reverse staggered a-SiTFT (amorphous-silicon thin film transistor). The structure is the same as that of a normal reverese staggered a-SiTFT. As shown in FIG. 5, the surrounding region of a-SiTFT comprises a gate electrode 26, a gate insulating film 27, a-Si (amorphous silicon) 28, a source electrode 29 and a drain electrode 30.

Figure 6:
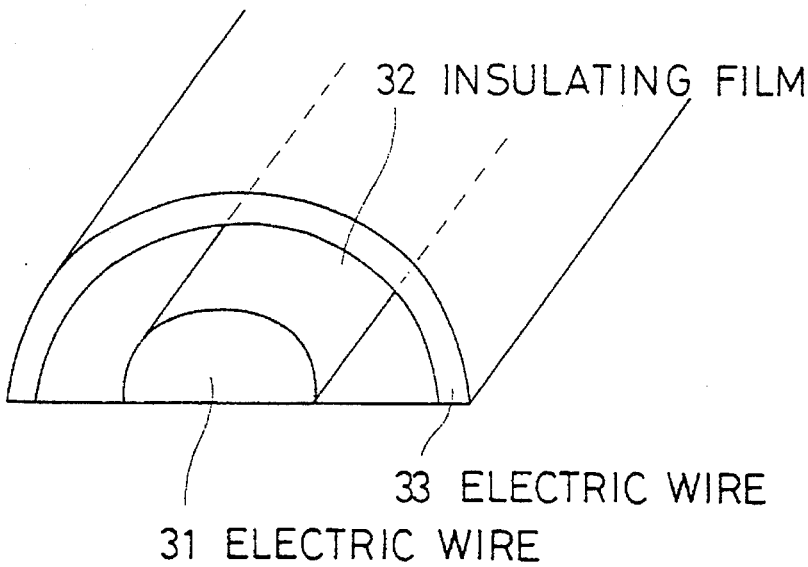
FIG. 6 is a view showing a structure of a transmission circuit for applying an inductance to a gate bus line.

FIG. 6 shows a structure of the transmission circuit for adding an inductance to the gate bus line. The transmission circuit comprises two transmission channels formed by an electric wire 31 for transmitting a signal of the gate bus line, an insulating film 32 added so as to cover the electric wire 31, and an electric wire 33. The transmission channel has a dome-like cross section having a configuration such that a coaxial cable is halved into two. Using the transmission channel having such structure allows adding an inductance to the transmission channel. In such case, the inductance is generated between the electric wire 31 for the gate bus line and the electric wire 33. A source bus line has the same structure.

In Embodiment 3, a reverse staggered a-SiTFT is used. However, the structure of the non-linear element for display can be of any type as long as the capacitance C of the element varies in a non-linear configuration with respect to the voltage.

As described above, in accordance with the present invention, an inductance is applied to the transmission channel of the display signal for the LCD. Thus the mode of transmitting the signal can be converted from propagation through diffusion to propagation through wave motion. This has resulted in a cessation in the generation of a deformation delay of image signals, which will contribute to a uniformity of the display and a high contrast of the display. Consequently, the present invention can be an epoch-making new technology for scale enlargement of the display and increase in the capacitance thereof.

What is claimed is:

1. A transmission circuit for applying a display signal to a pixel of a liquid crystal display, which comprises a transmission channel including a scanning line and a data signal line arranged in an intersecting matrix so that each intersection defines a pixel, and having a switching element with inputs connected respectively to said scanning line and to said data signal line, and an output driving a cell of said display, said switching element having a capacitance;

wherein an inductor having a predetermined inductance value is arranged at a regular interval in the transmission channel, thereby electrically separating each Nth pixel from an adjacent pixel, where N is an integer; and wherein said transmission circuit is driven by applying a voltage to the transmission channel and varying at least one of the capacitance and the inductance in a non-linear relation to the applied voltage while propagating the display signal either in the form of solitons or in the form of solitary waves.

2. A transmission circuit according to claim 1, wherein the inductor comprises a plurality of inductive elements which are arranged in the transmission channel spaced apart by one or a plurality of the pixels.

3. A transmission circuit according to claim 1, wherein the inductor comprises an active inductor.

4. A transmission circuit according to claim 1, wherein said transmission circuit is driven by obtaining, using a multi-solitions solution, a display signal having a pulse width wider than a basic pulse width, the basic pulse width being a pulse width of one-soliton solution, while propagating the display signal.

5. The transmission circuit of claim 1, wherein N is an integer less than 4.

6. The transmission circuit of claim 5, wherein N is an integer less than 3.

7. The transmission circuit of claim 6, wherein N is the integer 1.

8. The transmission circuit of claim 1, wherein said switching element is a Field Effect Transistor (FET).

9. The transmission circuit of claim 1, wherein said switching element is a semiconductor diode.

10. The transmission circuit of claim 1, further comprising means for applying a voltage signal to said transmission channel while non-linearly varying at least one of capacitance and inductance of said transmission circuit.

11. A transmission circuit, for applying a display signal to a pixel of a liquid crystal display, which comprises a transmission channel including a scanning line and a data signal line arranged in an intersecting matrix so that each intersection defines a pixel, and having a switching element with inputs connected respectively to said scanning line and to said data signal line, and an output driving a cell of said display, said switching element having a capacitance;

wherein an inductor having a predetermined inductance value is arranged at a regular interval in the transmission channel, thereby electrically separating each Nth pixel from an adjacent pixel, where N is an integer; and further comprising a signal generation circuit providing an LC circuit including inductors, wherein said transmission circuit is driven by using the signal generation circuit while propagating a display signal comprising solitons or solitary waves.

12. A transmission circuit, for applying a display signal to a pixel of a liquid crystal display, which comprises a transmission channel including a scanning line and a data signal line arranged in an intersecting matrix so that each intersection defines a pixel, and having a switching element with inputs connected respectively to said scanning line and to said data signal line, and an output driving a cell of said display, said switching element having a capacitance;

wherein an inductor having a predetermined inductance value is arranged at a regular interval in the transmission channel, thereby electrically separating each Nth pixel from an adjacent pixel, where N is an integer; and wherein said circuit has a ladder configuration with two major electrodes, said capacitances (C) being arranged as rungs and said inductors (L) being arranged in series along one of said major electrodes, each between a pair of rungs.

* * * * *